US007669983B2

(12) United States Patent
Sugahara

(10) Patent No.: US 7,669,983 B2
(45) Date of Patent: Mar. 2, 2010

(54) LIQUID DROPLET JETTING APPARATUS AND INK-JET PRINTER

(75) Inventor: Hiroto Sugahara, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 342 days.

(21) Appl. No.: 11/654,810

(22) Filed: Jan. 18, 2007

(65) Prior Publication Data

US 2007/0165080 A1 Jul. 19, 2007

(30) Foreign Application Priority Data

Jan. 18, 2006 (JP) ..... 2006-009574

(51) Int. Cl.
*B41J 2/045* (2006.01)

(52) U.S. Cl. ..... 347/68

(58) Field of Classification Search ..... 347/68, 347/69–72; 400/124.16
See application file for complete search history.

(56) References Cited

U.S. PATENT DOCUMENTS 7,524,040 B2 * 4/2009 Kusakari ..... 347/68

FOREIGN PATENT DOCUMENTS

JP 6143589 5/1994
JP 10291311 4/1998

* cited by examiner

*Primary Examiner*—K. Feggins
(74) *Attorney, Agent, or Firm*—Reed Smith LLP

(57) ABSTRACT

A head is formed by stacking a plurality of plates including a cavity plate and a manifold plate, and includes a plurality of manifolds formed in the manifold plate, a communicating channel which makes the manifolds formed in the manifold plate communicate, and a plurality of pressure chambers formed in the cavity plate, which communicate with the manifold. Each pressure chamber is isolated by a partition wall of the cavity plate. Since the communicating channel and the pressure chambers are formed at different positions in terms of height, it is possible to widen a width of the communicating channel without widening an interval between the pressure chambers, and it is possible to accelerate a movement of a liquid between the manifolds.

20 Claims, 10 Drawing Sheets

LIQUID DROPLET JETTING APPARATUS AND INK-JET PRINTER

CROSS REFERENCE TO RELATED APPLICATION

The present application claims priority from Japanese Patent Application No. 2006-009574, filed on Jan. 18, 2006, the disclosure of which is incorporated herein by reference in its entirety.

BACKGROUND OF THE INVENTION

1. Field of the Invention

The present invention relates to a liquid droplet jetting apparatus which jets a liquid droplet and an ink-jet printer which jets an ink.

2. Description of the Related Art

An ink-jet head which includes a plurality of pressure chambers communicating with a plurality of nozzles respectively, and a common liquid chamber supplying an ink to these pressure chambers, and which jets a droplet of the ink from a nozzle has hitherto been known. Such an ink-jet head selectively applies a pressure to the ink in the pressure chambers, and jets a droplet of the ink on to a recording paper from a nozzle communicating with the pressure chamber which is selected. For example, a serial ink-jet head described in Japanese Patent Application Laid-open No. H10-291311 includes a plurality of pressure chamber rows (three pressure chamber rows), and each pressure chamber row includes a plurality of pressure chambers (ink cavities) arranged in a longitudinal direction (paper feeding direction) of the serial ink-jet head. Furthermore, a common liquid chamber (ink supply chamber) which supplies the ink to each of the pressure chambers is extended along the longitudinal direction of the serial ink-jet head, in an area on an outer side of the pressure chamber rows and an area on an inner side (between the adjacent pressure chamber rows) of the pressure chamber rows.

The common liquid chamber which is arranged at the inner side of the two adjacent pressure chamber rows supplies ink to each of the pressure chambers belonging to the two pressure chamber rows positioned at both sides thereof. Therefore, in a case in which it is necessary to jet the ink simultaneously from a multiple number of pressure chambers, since an amount of ink supplied to the pressure chambers from the common liquid chamber at the inner side is increased temporarily, there is a possibility that the sufficient amount of ink is not supplied to each pressure chamber. Therefore, in the ink-jet head described in Japanese Patent Application Laid-open No. H10-291311, an ink communicating channel which communicates the common liquid chamber at the inner side with the common liquid chamber at the outer side, is provided in a partition wall (a column) which partitions the pressure chambers belonging to the each pressure chamber row. Moreover, when the amount of ink which is supplied from the common liquid chamber at the inner side, to the pressure chamber is increased temporarily, the ink is replenished from the common liquid chamber at the outer side to the common liquid chamber at the inner side via the ink communicating channel. Therefore, an insufficiency of the ink in the common liquid chamber at the inner side is prevented to a possible extent.

SUMMARY OF THE INVENTION

However, in the ink-jet head described in the Japanese Patent Application Laid-open No. H10-291311, the ink communicating channel which communicates the common liquid chamber at the inner side with the common liquid chamber at the outer side communicate is provided on a partition wall which partitions (isolates) the pressure chambers belonging to each pressure chamber row. Consequently, an interval (gap) between the pressure chambers in the pressure chamber row is increased, and the head becomes large.

On the other hand, for preventing the insufficiency of ink temporarily in the common liquid chamber at the inner side, as it has been mentioned above, apart from making the common liquid chamber at the inner side and the common liquid chamber at the outer side communicate, it is effective to increase a width of the common liquid chamber at the inner side. However, in this case, an interval between the two nozzle rows corresponding to the two pressure chamber rows communicating with the common liquid chamber at the inner side is increased, and with an increase in the interval, a width of the head is also increased. Therefore, it causes an increase in the size of the head. Moreover, in a case in which an interval between the two adjacent nozzle rows is substantial, when the recording paper is transported somewhat inclined with respect to a normal feeding direction, there is an increase in an uneven print density (banding) and white stripes which are caused due to the inclination of the feeding direction. Therefore, wider the interval between the nozzle rows, the printing quality tends to be further declined.

For preventing the insufficiency of ink temporarily in the common liquid chamber at the inner side, increasing a volume of the common liquid chamber by making the common liquid chamber deep is considered to be effective. However, in this case also, it causes an increase in the size of the head. In addition, when the head is formed by stacking thin plates, since the number of plates becomes large, a cost of forming the head is increased.

In a line ink-jet printer, for performing the printing with a predetermined resolution, the nozzles are to be arranged at a pitch in accordance with the resolution. Moreover, a length of the ink-jet head has to be longer than a width of the recording paper (or a width of a printing area). Consequently, in a case of performing printing at a high resolution by using the line ink-jet head, a large number of nozzles are to be arranged highly densely, and with such an arrangement, the amount of ink supplied from the common liquid chamber to the pressure chamber is also increased. Consequently, the problem of the insufficiency of ink mentioned above becomes remarkable.

An object of the present invention is to reduce a width of the common liquid chamber in a liquid droplet jetting apparatus, for example, regarding the liquid chamber which is arranged at the inner side of the pressure chamber row, to prevent an insufficiency in an amount of liquid in the common liquid chamber, and to provide an inkjet printer using such a common liquid chamber.

According to a first aspect of the present invention, there is provided a liquid droplet jetting apparatus including, a channel unit which includes a plurality of nozzles, a plurality of pressure chambers arranged in a predetermined plane, a partition wall partitioning the pressure chambers, a plurality of common liquid chambers supplying the liquid to the pressure chambers, a plurality of liquid channels communicating the nozzles, the pressure chambers, and the common liquid chambers, and a communicating channel communicating the common liquid chambers; and a pressure applying mechanism which applies selectively a jetting pressure to the liquid in the pressure chambers.

The communicating channel is formed in the channel unit, at a position which overlaps with the partition wall in an orthogonal direction which is orthogonal to a planar direction of the predetermined plane, and which is different from the pressure chamber in the orthogonal direction.

According to the first aspect of the present invention, since the common liquid chambers communicate via the communicating channel, when the liquid in the common liquid chamber is insufficient, for example, when a substantial amount of the liquid is supplied to the pressure chamber normally, it is possible to replenish the liquid from another common liquid chamber through the communicating channel. Moreover, since the communicating channel is formed at a height different from the pressure chamber, it is possible to increase a width of the communicating channel irrespective of an interval (gap) between the pressure chambers. Therefore, even in a case of replenishing a substantial amount of liquid from a certain common liquid chamber to another common liquid chamber, it is possible to supply the liquid rapidly and assuredly. The word "an orthogonal direction" is defined as a direction orthogonal to the predetermined plane regardless of the orientation of the liquid droplet jetting apparatus.

In the liquid droplet jetting apparatus of the present invention, the pressure chambers may be arranged as a plurality of pressure chamber rows each of which is comprised of pressure chambers arranged in a first direction; the common liquid chambers may include outer common liquid chambers which are extended in the first direction at a further outer side of the pressure chamber row arranged on an outermost side in a second direction orthogonal to the first direction, and which communicate with pressure chambers belonging to the pressure chamber row on the outermost side, and inner common liquid chambers which are extended in the first direction between two mutually adjacent pressure chamber rows and which communicate with pressure chambers belonging to the two adjacent pressure chamber rows; and the inner common liquid chambers and the outer common liquid chambers may communicate mutually via the communicating channel.

In this case, the liquid is supplied from the outer common liquid chamber which is arranged at the outer side of the pressure chamber rows, and the inner common liquid chamber which is arranged between the pressure chamber rows, to the pressure chambers included in the pressure chamber rows. Moreover, the jetting pressure is applied to the liquid in the pressure chambers by the jetting pressure applying mechanism, and the liquid is jetted from the nozzle which communicates with the pressure chamber to which the jetting pressure is applied.

Since the outer common liquid chamber and the inner common liquid chamber communicate via the communicating channel, when an amount of liquid supplied from the inner common liquid chamber is substantial as in a case in which the liquid is jetted simultaneously from a multiple number of nozzles, the liquid is replenished from the outer common liquid chamber to the inner common liquid chamber via the communicating channel. Therefore, an occurrence of an insufficiency of the liquid in the inner common liquid chamber is prevented. Consequently, it is possible to narrow an interval between the two pressure chamber rows communicating with the inner common liquid chamber (gap between the two nozzle rows corresponding to these two pressure chamber rows), by decreasing a width of the inner common liquid chamber (length in a direction orthogonal to a direction in which the inner common liquid chamber is extended). Furthermore, the communicating channel is arranged at a position which is different in a direction orthogonal to a plane in which the pressure chambers are arranged. In other words, since the communicating channel and the pressure chamber are arranged on different planes, it is possible to arrange the pressure chamber and the communicating channel overlapping mutually, and to provide a wide communicating channel without increasing the gap between the pressure chambers in each pressure chamber row.

In the liquid droplet jetting apparatus of the present invention, the communicating channel may be extended in the second direction. In this case, it is possible to reduce the length of the communicating channel, and to replenish the liquid rapidly from the outer common liquid chamber to the inner common liquid chamber.

In the liquid droplet jetting apparatus of the present invention, the nozzles may be formed in the channel unit at positions different from positions of the pressure chamber in the orthogonal direction; the liquid channels may include a connecting portion which connects the pressure chamber and the nozzle and which is extended in the orthogonal direction; and the communicating channel may be formed at a same position as the connecting portion of the liquid channel in the orthogonal direction. In this case, the pressure chamber and the nozzle positioned on mutually different planes communicate mutually via the communicating channel (the connecting portion of the liquid channel), and the communicating channel and another communicating channel are arranged at a same position in the direction orthogonal to the plane on which the pressure chambers are arranged. Therefore, the communicating channel and the pressure chamber are inevitably arranged on mutually different planes.

In the liquid droplet jetting apparatus of the present invention, a width of the communicating channel may be more than a length of the partition wall in the first direction. Since the communicating channel is arranged on a plane different from a plane on which the pressure chambers are arranged, it is possible to make the liquid flow assuredly between the outer common liquid chamber and the inner common liquid chamber by increasing the width of the communicating channel (length in the direction orthogonal to the direction in which the communicating channel is extended) to be more than the partition wall which isolates the pressure chambers.

In the liquid droplet jetting apparatus of the present invention, the communicating channel may include a communicating portion which communicates with the outer common liquid chambers and the inner common liquid chambers at both side of the communicating channel, and a midway portion between the communicating portions; and the communicating portion may be wider than the midway portion. In this case, the liquid is tends to flow easily from the outer common liquid chamber and the inner common liquid chamber, to the communicating channel, a flow of the liquid between the outer common liquid chamber and the inner common liquid chamber is facilitated.

In the liquid droplet jetting apparatus of the present invention, the communicating channel may include a plurality of liquid chamber communicating channels, and the liquid chamber communicating channels may be formed in the channel unit at positions overlapping with all the partition walls. In this case, since the liquid chamber communicating channels are provided at positions overlapping with the partition walls respectively, it is possible to prevent assuredly an occurrence of a local liquid insufficiency in the inner common liquid chamber.

In the liquid droplet jetting apparatus of the present invention, the outer common liquid chamber may be wider than the inner common liquid chamber. In this case, it is possible to supply a sufficient amount of liquid from the outer common liquid chamber to the inner common liquid chamber.

In the liquid droplet jetting apparatus of the present invention, the channel unit may have a plurality of stacked plates including a first plate in which the pressure chambers are formed and a second plate in which the communicating channel is formed. In this case, since the communicating channel is formed in a plate different from the plate in which the pressure chambers are formed, the liquid chamber communicating channel and the pressure chambers are inevitably arranged on different planes.

In the liquid droplet jetting apparatus of the present invention, the liquid chamber communicating channel may be formed by a recess which is formed in one surface of the second plate. When the communicating channel is formed in the form of a recess on one surface of the plate in such manner, unlike a case in which the communicating channel is formed to be a through hole pierced through the plate, each portion of the plate is not divided by the communicating channel, and moreover, since a stiffness of the plate is also ensured to some extent, handling of the plate during the manufacturing becomes easy.

In the liquid droplet jetting apparatus of the present invention, the common liquid chamber may be formed in the second plate, or the nozzles may be formed in the second plate. Moreover, in the liquid droplet jetting apparatus of the present invention, the second plate may include two plates which are stacked adjacently, and the communicating channel may be formed by recesses which are formed on mutually facing surfaces of the two plates. In any of these cases, since it is possible to form the communicating channel in a plate different from the plate in which the pressure chambers are formed, it is possible to ensure a sufficient width of the communicating channel without widening the interval between the adjacent pressure chambers.

In the liquid droplet jetting apparatus of the present invention, a length of the connecting portion of the liquid channel in the first direction may be less than a length of the pressure chamber in the first direction, and a length of the connecting portion of the liquid channel in the first direction may be less than a length of the communicating channel in the first direction. In any of these cases, it is possible to ensure the sufficient width of the communicating channel.

According to a second aspect of the present invention, there is provided an ink-jet printer which jets a droplet of an ink on to a medium, including a transporting mechanism which transports the medium in a predetermined direction, and a head which includes a channel unit which has a plurality of nozzles, a plurality of pressure chambers arranged in a predetermined plane, a partition wall partitioning the pressure chambers, a plurality of liquid channels communicating the nozzles, the pressure chambers, and the common liquid chambers, and a communicating channel communicating the common liquid chambers, and a pressure applying mechanism which applies selectively a jetting pressure to the liquid in the pressure chambers. The communicating channel is formed in the channel unit, at a position which overlaps with the partition wall in an orthogonal direction which is orthogonal to a planar direction of the predetermined plane, and which is different from the pressure chamber in the orthogonal direction.

According to the second aspect of the present invention, since the common liquid chambers communicate via the communicating channel, and the ink can move between these common liquid chambers, even in a case of discharging a substantial amount of ink, there is no possibility of occurrence of the insufficiency of the ink in the common liquid chamber.

DETAILED DESCRIPTION OF THE PREFERRED EMBODIMENTS

An embodiment of the present invention will be described below. This embodiment is an example in which, the present invention is applied to a line ink-jet printer which jets a droplet of an ink on to a recording paper, as a liquid droplet jetting apparatus.

Figure 1:
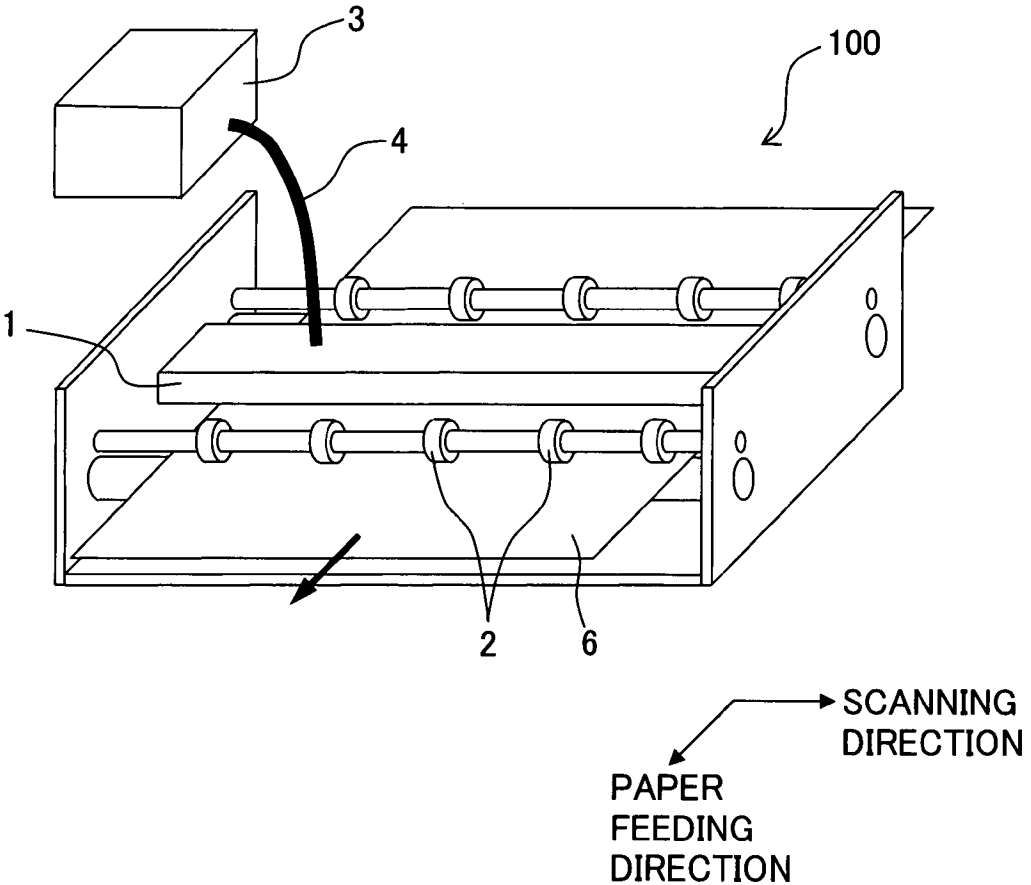
FIG. 1 is a schematic structural view of an ink-jet printer according to an embodiment of the present invention.

Firstly, an ink-jet printer 100 which includes an ink-jet head of this embodiment will be described below. As shown in FIG. 1, the ink-jet printer 100 includes a line ink-jet head (head) 1 which is extended in a direction of width of a recording paper (paper) 6 (scanning direction: left and right direction in FIG. 1), transporting rollers 2 which transport the paper 6 in a forward direction, an ink tank 3 which stores the ink which is to be supplied to the head 1, and a tube 4 which connects the ink tank 3 and the head 1. The head 1 jets the ink supplied from the ink tank 3 via the tube 4, on to the paper 6 from a plurality of nozzles 20 arranged in the scanning direction on a lower surface of the head 1, and records desired characters and/or image on to the paper 6. The paper P with the image formed thereon is transported by the transporting rollers 2 in the forward direction (paper feeding direction).

As shown in FIG. 2 to FIG. 5, the head 1 includes a channel unit 7 in which, nozzles 20, pressure chambers 14, and manifolds 17, and ink channels (liquid channels) which connect the nozzles 20, the pressure chambers 14, and the manifolds 17 are formed, and a piezoelectric actuator 8 (jetting pressure applying mechanism) which is arranged on an upper surface of the channel unit 7, and applies selectively a jetting pressure to the ink in the pressure chambers 14.

Figure 4:
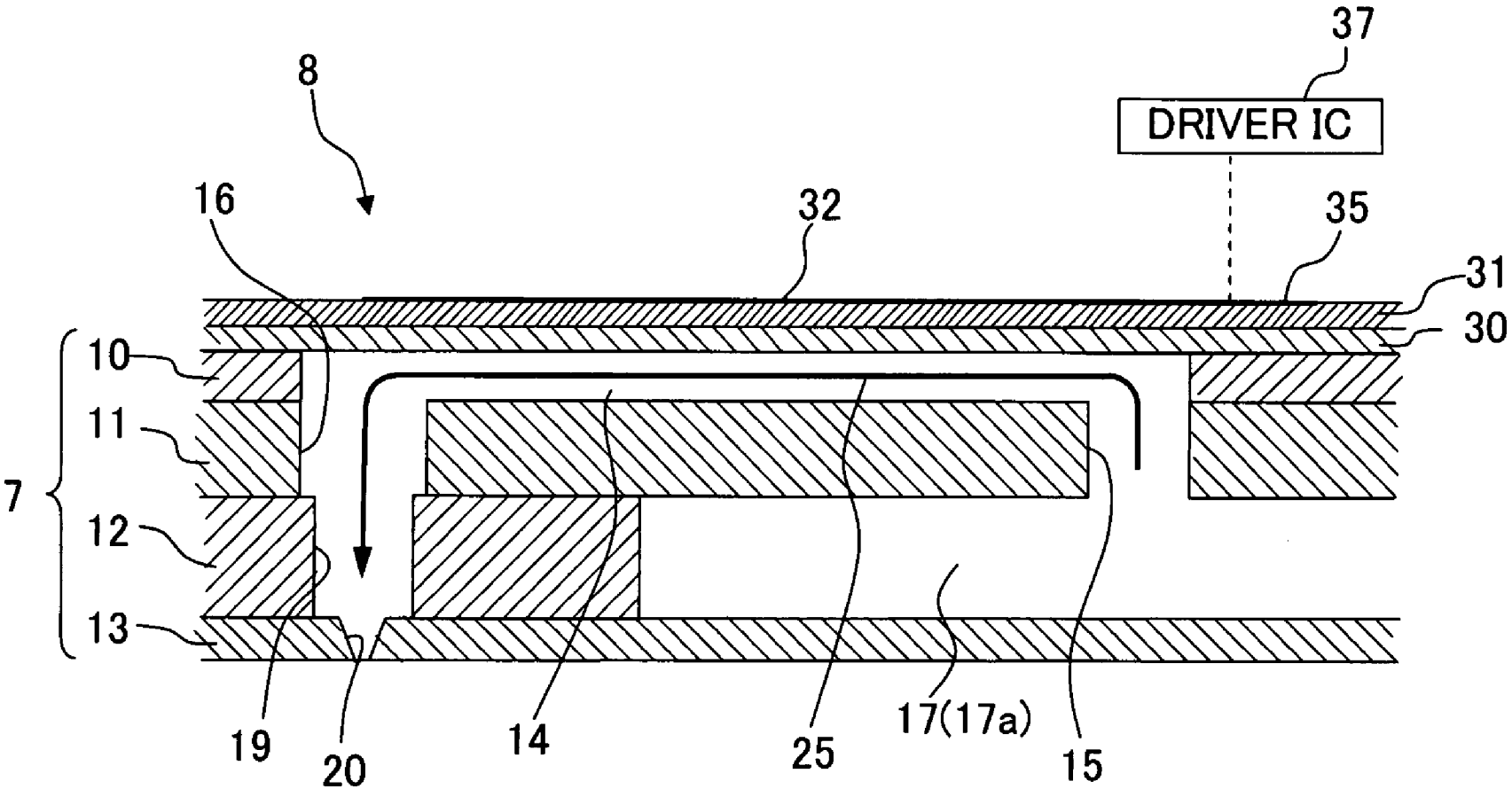
FIG. 4 is a cross-sectional view taken along a line IV-IV shown in FIG. 3.
Figure 5:
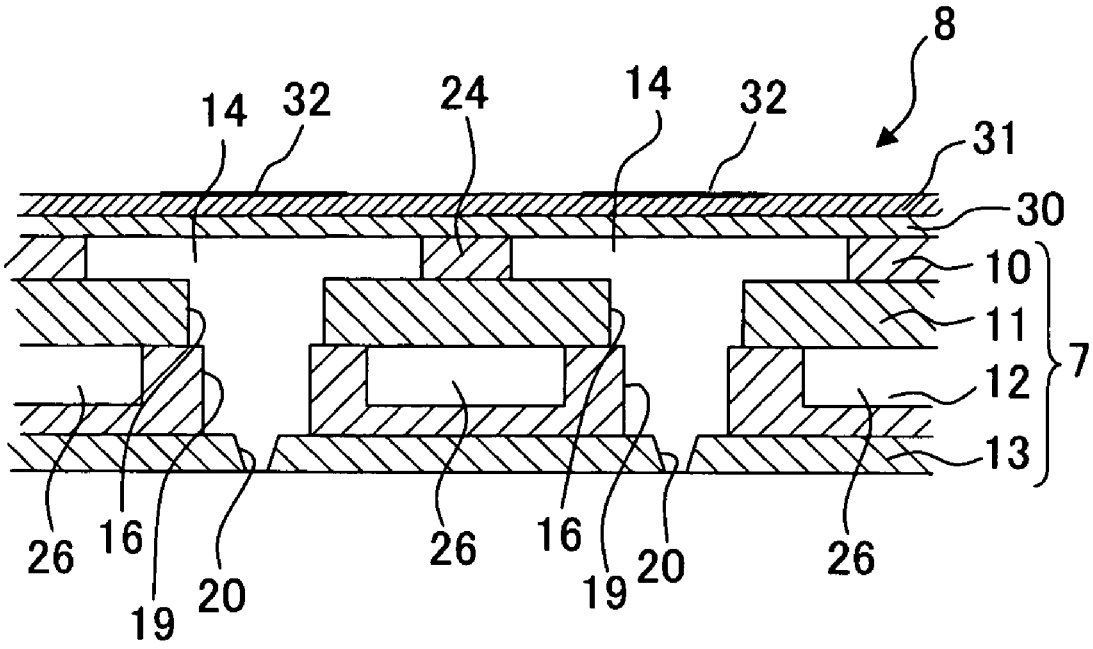
FIG. 5 is a cross-sectional view taken along a line V-V shown in FIG. 3.

Firstly, the channel unit 7 will be described below. As shown in FIG. 4 and FIG. 5, the channel unit 7 includes a cavity plate 10, a base plate 11, a manifold plate 12, and a nozzle plate 13, and these four plates 10 to 13 are joined in a stacked form. The cavity plate 10, the base plate 11, and the manifold plate 12 are stainless steel plates. Consequently, and the ink channels including the manifold 17 and the pressure chambers 14 which will be described later, can be formed easily in these three plates 10 to 12 by an etching. Moreover, the nozzle plate 13 is formed of a high-molecular synthetic resin material such as polyimide, and is adhered to a lower surface of the manifold plate 12. The nozzle plate 13 also, may be formed of a metallic material such as stainless steel similar to the three plates 10 to 12.

As shown in FIG. 2 to FIG. 5, in the cavity plate 10 which is at an uppermost position in the layered structure of the four plates 10 to 13, six pressure chamber rows 21 (21*a* to 21*f*) are arranged along a plane, in the paper feeding direction (second direction). Each pressure chamber row 21 includes the plurality of pressure chambers 14 arranged in the scanning direction (vertical direction in FIG. 2, first direction). These pressure chambers 14 are covered by the base plate 11 and a vibration plate 30 which will be described later, from both an upper and a lower side. Each pressure chamber 14 is formed to be substantially elliptical shaped with a longitudinal axis of the elliptical shape in the paper feeding direction (vertical direction in FIG. 2).

Figure 2:
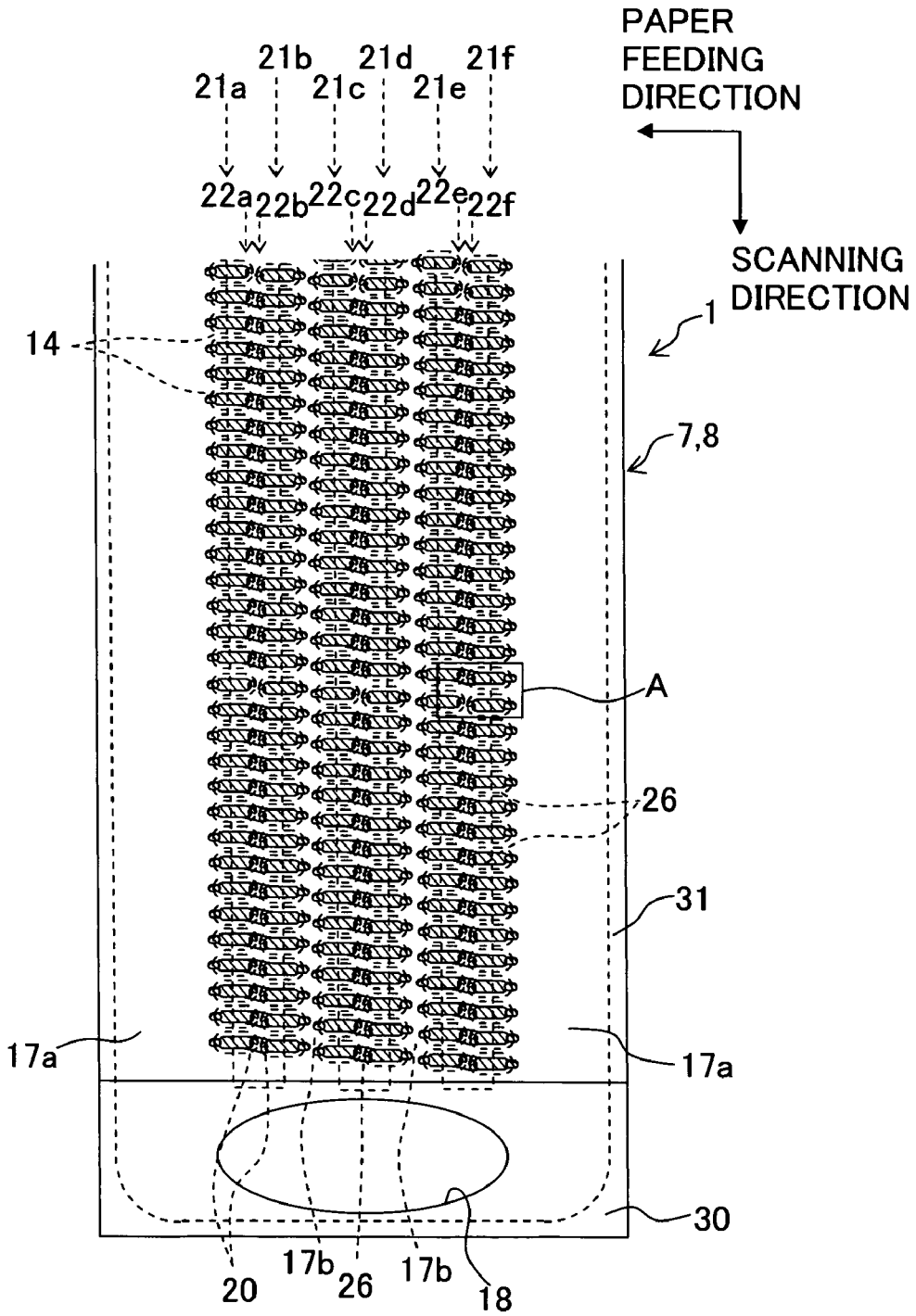
FIG. 2 is a partially enlarged plan view of a line ink-jet head.
Figure 3:
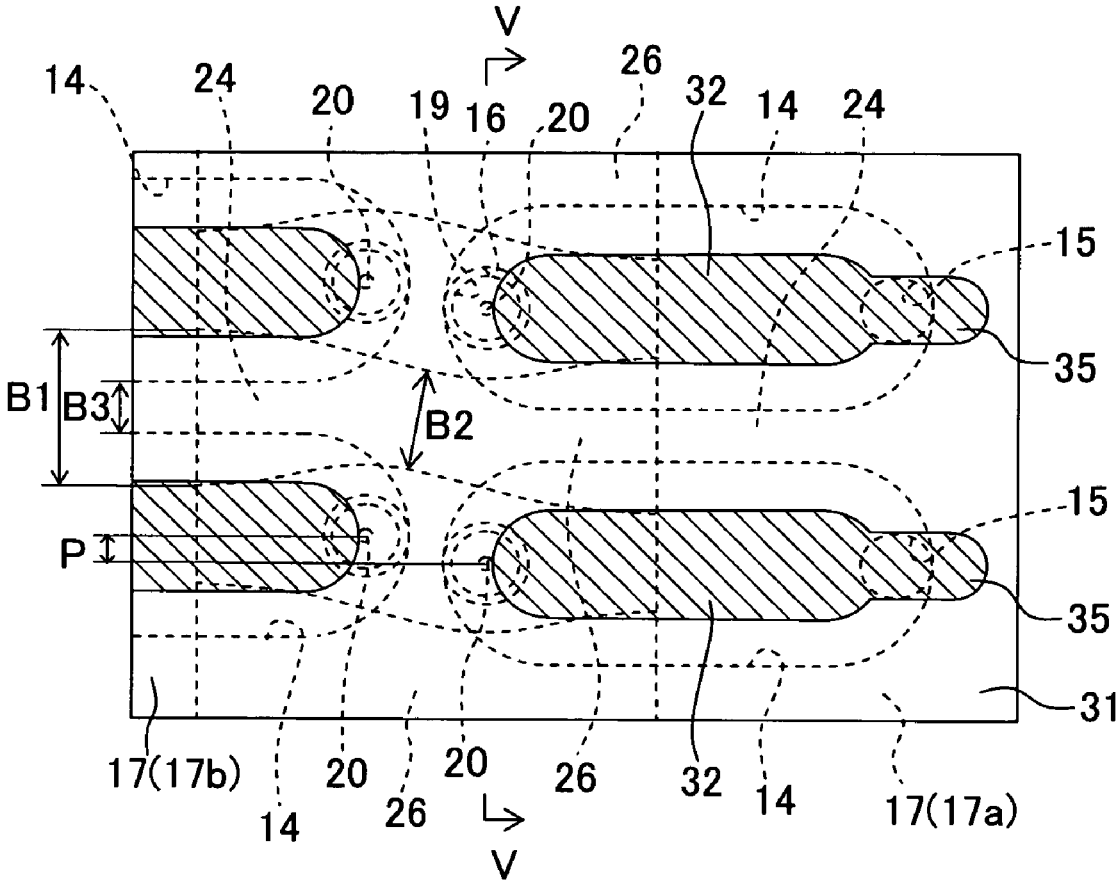
FIG. 3 is an enlarged view of a section A of FIG. 2.

As shown in FIG. 2 and FIG. 3, the six pressure chamber rows 21*a* to 21*f* are arranged to be separated by a pitch P in a direction in which the pressure chamber rows 21*a* to 21*f* are arranged (vertical direction in FIG. 2 and FIG. 3). Moreover, the pressure chambers 14 belonging to the pressure chamber rows 21 are divided by a partition wall 24.

As shown in FIG. 3 and FIG. 4, communicating holes 15 and 16 are formed in the base plate 11, at positions overlapping with both end portions of the pressure chamber 14 in a plan view. Moreover, four manifolds 17 which are extended in the scanning direction (vertical direction in FIG. 2) are formed in the manifold plate 12. These four manifolds 17 communicate with an ink supply port 18 which is formed in the vibration plate 30 which will be described later, and the ink is supplied to the manifolds 17 from the ink tank 3 (refer to FIG. 1) via the ink supply port 18.

As shown in FIG. 2, the manifolds 17 includes two outer manifolds 17*a* (outer common liquid chambers) which are arranged at both sides of the head 1, in the left and right direction in FIG. 2, and two inner manifolds (inner common liquid chambers) 17*b* which are arranged on an inner side thereof. The two outer manifolds 17*a* (outer common liquid chambers) are arranged in an area at a further outer side than the pressure chamber rows 21 to 21*f* positioned at both ends of the head 1, in the left and right direction (paper feeding direction) in FIG. 2. Furthermore, these two outer manifolds 17*a* overlap partially with the pressure chambers 14 belonging to the pressure chamber rows 21*a* to 21*f* on both left and right side, in a plan view, and communicate with the pressure chambers 14 thereof via the communicating holes 15. Whereas, the two inner manifolds 17*b* (inner common liquid chambers) are arranged in an area between the second pressure chamber row 21*b* from left and the third pressure chamber row 21*c* from left, and another area between the fourth pressure chamber row 21*d* from left and the fifth pressure chamber row 21*e* from left. Furthermore, each of the inner manifolds 17*b* overlaps partially with the pressure chambers 14 belonging to the two pressure chamber rows 21 positioned at both sides thereof in a plan view, and communicates with the pressure chambers 14 thereof via the communicating holes 15. Moreover, a width (length in the paper feeding direction) of the outer manifold 17*a* is more than a width of the inner manifold 17*b*.

Moreover, as shown in FIG. 3 to FIG. 5, a plurality of communicating holes 19 which communicate with the communicating holes 16, is formed in the manifold plate 12, at positions overlapping with an end portion of the pressure chambers 14 on a side opposite to the manifold 17, in a plan view.

Furthermore, the plurality of nozzles 20 is formed in the nozzle plate 13, at positions overlapping with the communicating holes 19 respectively, in a plan view. As shown in FIG. 2, the nozzles 20 are arranged in a row in the scanning direction (vertical direction in FIG. 2), in an area not overlapping in a plan view with the four manifolds 17 (an area between the pressure chamber rows 21*a* and 21*b*, between the pressure chamber rows 21*c* and 21*d*, and between the pressure chamber rows 21*e* and 21*f*), and form six nozzle rows 22*a* to 22*f* corresponding to the six pressure chamber rows 21*a* to 21*f* respectively. The six nozzle rows 22*a* to 22*f*, similar to the six pressure chamber rows 21*a* to 21*f*, are separated by the pitch P in a direction of arrangement thereof (vertical direction in FIG. 2 and FIG. 3).

As shown in FIG. 4, the manifold 17 communicates with the pressure chamber 14 via the communicating hole 15, and the pressure chamber 14 communicate with the nozzle 20 via the communicating holes 16 and 19. Thus, a plurality of individual ink channels 25 running from the manifolds 17 up to the nozzles 20 via the pressure chambers 14, is formed in the channel unit 7.

Figure 6A:
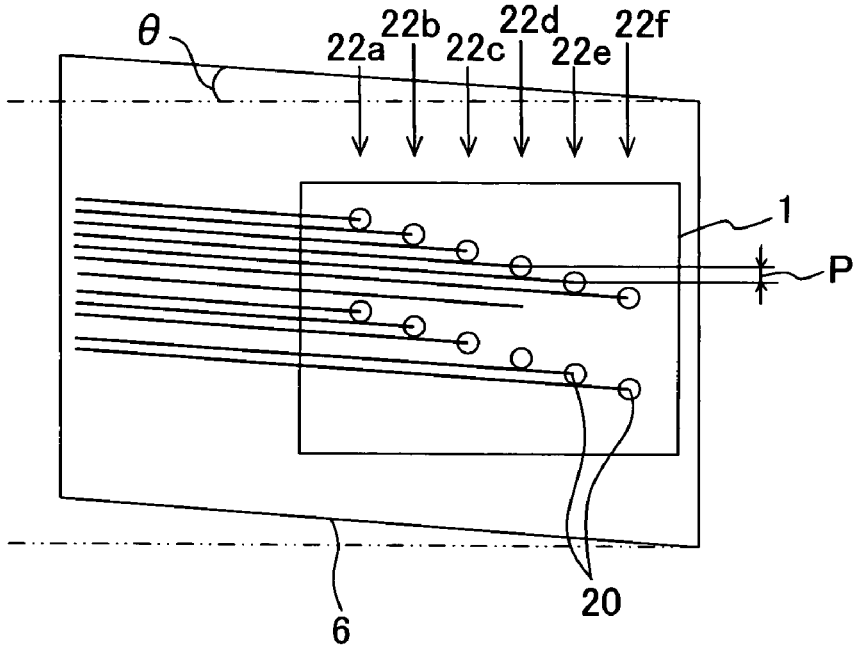
FIG. 6A is a diagram showing an effect of an interval between adjacent nozzle rows on a printing quality when the interval between the nozzle rows is narrow.
Figure 6B:
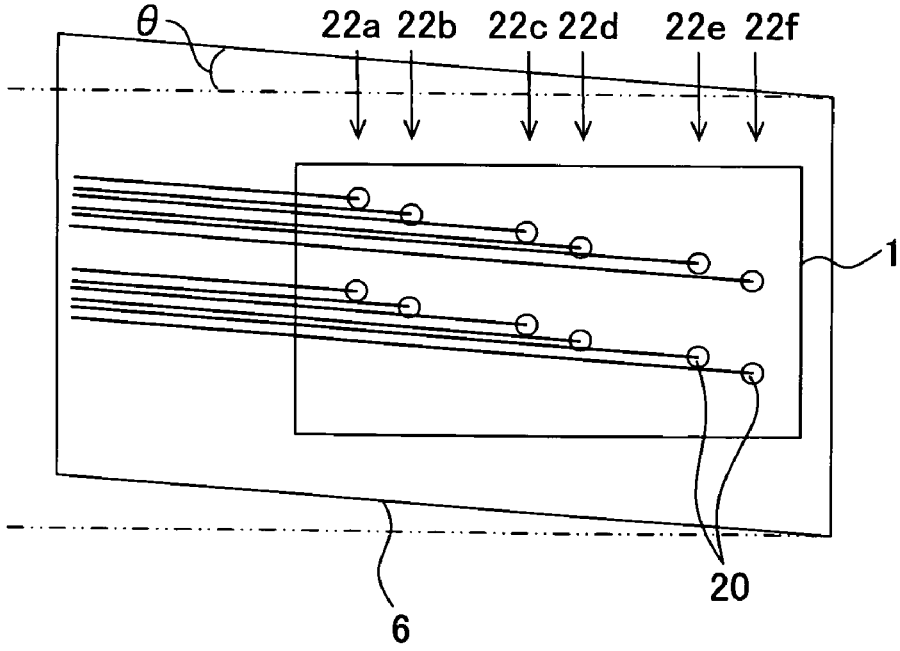
FIG. 6B is a diagram showing an effect of an interval between adjacent nozzle rows on the printing quality when the interval between the nozzle rows is wide.

When the interval between the adjacent nozzle rows 22 is substantial, a width of the head 1 is increased by that much amount, and a size of the head 1 is increased. As shown in FIG. 6A and FIG. 6B, when the paper 6 is transported at an angle inclined by a certain angle θ from a normal paper feeding direction, wider the interval between the two adjacent nozzle rows 22 (FIG. 6B), an interval between lines (dots) formed by the ink jetted from each nozzle becomes non-uniform, and a print density becomes uneven (banding) and/or white stripes become large, and a printing quality is declined substantially. Therefore, it is preferable that the width of the inner manifolds 17*b* is made as small as possible, and the interval between the nozzle row 22*b* and the nozzle row 22*c*, and the interval between the nozzle row 22*d* and the nozzle row 22*e* are made as small as possible.

However, when the width of the inner manifolds 17*b* is decreased, a volume of the inner manifolds 17*b* is decreased. Consequently, for example, in a case such as jetting the ink simultaneously from the plurality of nozzles to which the ink is supplied from one inner manifold 17*b*, there is an insufficiency of ink stored in the inner manifold 17*b*, and there is a possibility that the sufficient amount of ink cannot be supplied to each pressure chamber 14.

As shown in FIG. 2, FIG. 3, and FIG. 5, in the head 1 of this embodiment, a plurality of communicating channels 26 (liquid chamber communicating channels) which communicates the outer manifold 17*a* with the inner manifold 17*b*, is formed in the manifold plate 12. As shown in FIG. 2 and FIG. 3, these communicating channels 26 are arranged at positions on the manifold plate 12, overlapping with a partition wall 24 which divides the pressure chambers 14 belonging to each pressure chamber row 21. Since the inner manifold 17*b* and the outer manifold 17*a* communicate mutually, when there is a temporary insufficiency of ink in the inner manifold 17*b*, the ink is replenished from the outer manifold 17*a* via these communicating channels 26. For preventing assuredly a local insufficiency of ink in the inner manifold 17*b*, it is preferable that the communicating channels 26 are arranged at positions on the manifold plate 12, overlapping with all the partition walls 24 respectively, as shown in FIG. 2.

Each communicating channel 26 is extended in the paper feeding direction (left and right direction in FIG. 2 and FIG. 3). In other words, in the communicating channel 26, since the outer manifolds 17*a* and the inner manifolds 17*b* are connected by the most direct way, the ink is supplied rapidly from the outer manifolds 17*a* to the inner manifolds 17*b*. As shown in FIG. 3, a width B1 of a communicating portion between the outer manifolds 17*a* and the inner manifolds 17*b*, of each communicating channel 26 is more than a width B2 of a midway portion of each communicating channel 26. Therefore, the ink flows easily from the outer manifolds 17*a* and the inner manifolds 17*b*, into the communicating channel 26, and the ink moves rapidly between the outer manifold 17*a* and the inner manifold 17*b*.

As shown in FIG. 5, the pressure chambers 14 and the nozzles 20 positioned on mutually different planes communicate via the communicating holes 16 and 19 extended in a direction of thickness of the plates. Whereas, the communicating channels 26 are arranged at the same positions as the communicating holes 19 (communicating channel, connecting portion), in the direction of thickness of the plates (direction orthogonal to a plane on which the pressure chambers 14 are arranged, orthogonal direction, height direction). The communicating channels 26 are formed in the manifold plate 12, and the pressure chambers 14 are formed in the cavity plate 10. Since these plates are arranged at different positions in the direction of thickness of the plates, the pressure chambers 14 and the communicating channels 26 are formed at mutually different positions in the direction of thickness of the plates. In other words, the pressure chambers 14 and the communicating channels 26 are arranged on mutually different planes. Therefore, it is possible to arrange the communicating channels 26 and the pressure chambers 14 to be overlapping in a plan view. In this embodiment, as shown in FIG. 3 and FIG. 5, the communicating channels 26 are formed to overlap with a portion near an outer edge of the pressure chambers 14 in a plan view, and a width B1 of the communicating portion of the communicating channels 26 is more than a width B3 of the partition wall 24. Consequently, it is possible to facilitate replenishing of the ink to the inner manifolds 17*b* by widening the communicating channels 26, and to reduce a size of the head 1 by decreasing as much as possible the interval between the pressure chambers 14 in each pressure chamber row 21.

As shown in FIG. 5, the communicating channels 26 are formed in a form of recesses by a half etching in an upper surface of the manifold plate 12. Therefore, unlike a case in which the communicating channels 26 are formed as through holes in the manifold plate 12, each portion of the manifold plate 12 is not divided by the communicating channels 26. Furthermore, since a stiffness of the manifold plate 12 is secured to some extent, a handling at the time of manufacturing becomes easy.

Next, the piezoelectric actuator 8 will be described below. As shown in FIG. 2 to FIG. 5, the piezoelectric actuator 8 includes the vibration plate 30 which is arranged on an upper surface of the channel unit 7, a piezoelectric layer 31 which is formed continuously spreading over the pressure chambers 14 on an upper surface of this vibration plate 30, and a plurality of individual electrodes 32 which are formed corresponding to the pressure chambers 14 on an upper surface of the piezoelectric layer 31, respectively.

The vibration plate 30 is a substantially rectangular shaped electroconductive plate in a plan view, and is an electroconductive metallic plate which is made of a material such as an iron alloy like stainless steel, a copper alloy, a nickel alloy, or a titanium alloy. This vibration plate 30 is arranged on an upper surface of the cavity plate 10, to cover the pressure chambers 14, and is joined to the cavity plate 10. Moreover, the vibration plate 30 is kept at a ground electric potential all the time, and serves as a common electrode which faces the individual electrodes 32 and which generates an electric field in a direction of thickness in the piezoelectric layer 31 between the vibration plate 30 and the individual electrodes 32.

The piezoelectric layer 31 which is composed of mainly lead zirconate titanate (PZT) which is a solid solution of lead titanate and lead zirconate, and is a ferroelectric substance is formed on the upper surface of the vibration plate 30. The piezoelectric layer 31 is formed continuously spreading over the pressure chambers 14. Moreover, the piezoelectric layer 31 is formed by an aerosol deposition (AD method) in which an ultra fine particle material is deposited by colliding at a high speed. It is also possible to use a sol-gel method, a sputtering method, a hydrothermal synthesis method, or a chemical vapor deposition (CVD method) for forming the piezoelectric layer 31. Furthermore, it is also possible to form the piezoelectric layer 31 by sticking on a surface of the vibration plate 30, a piezoelectric sheet which is obtained by baking a green sheet of PZT.

The plurality of individual electrodes 32 which are substantially elliptical and slightly smaller than the pressure chamber 14 is formed on the upper surface of the piezoelectric layer 31. These individual electrodes 32 are formed on the upper surface of the piezoelectric layer 31, at positions overlapping with the corresponding pressure chambers 14 in a plan view. The individual electrodes 32 are formed of an electroconductive material such as gold, copper, silver, palladium, platinum, or titanium. Further, from one end portion of the individual electrodes 32 (end portion in a side of the manifolds 17), a plurality of contact points 35 is drawn in a longitudinal direction of each individual electrode 32. Contact points of a flexible wiring member (omitted in the diagram) such as a flexible printed circuit (FPC) are connected to these contact points 35, and via this wiring member, these contact points are electrically connected to a driver IC 37 which supplies selectively a drive voltage to the individual electrodes 32. It is possible to form the individual electrodes 32 and the contact points 35 by a method such as a screen printing, the sputtering, or a vapor deposition.

Next, an action of the piezoelectric actuator 8 at the time of jetting a droplet of ink from the nozzle 20 will be described below. When the drive voltage is applied selectively from the driver IC 37 to the individual electrodes 32, an electric potential of the individual electrodes 32 on an upper side of the piezoelectric layer 31 to which the drive voltage is applied differs from an electric potential of the vibration plate 30 which serves as the common electrode at a lower side of the piezoelectric layer 31 and which is kept at the ground electric potential. Therefore an electric field in a direction of thickness is generated in the piezoelectric layer 31 sandwiched between the individual electrodes 32 and the vibration plate 30. When a direction in which the piezoelectric layer 31 is polarized and a direction of the electric field are same, the piezoelectric layer 31 is elongated in the direction of thickness in which the piezoelectric layer 31 is polarized, and is contracted in a horizontal direction. Further, with a deformation due to contraction of the piezoelectric layer 31, since the vibration plate 30 is deformed to form a projection toward the pressure chamber 13, a volume of the pressure chamber 14 is decreased. As the volume of the pressure chamber 14 is decreased, a jetting pressure is applied to the ink in the pressure chamber 14, and an ink droplet is jetted from a nozzle 20 communicating with the pressure chamber 14.

As it has been mentioned earlier, in this embodiment, in order to miniaturize the head 1 and improve the printing quality, the width of the inner manifold 17*b* positioned between the two adjacent pressure chamber rows 21 is narrow, and a volume of the inner manifold 17*b* b is decreased due to narrowing. Consequently, an amount of ink accommodated in the inner manifold 17*b* is small. On the other hand, the number of pressure chambers 14 communicating with the inner manifold 17*b* is more than the number of pressure chambers 14 communicating with the outer manifold 17*a*. Therefore, in cases such as a case of jetting the ink at a time from a large number of nozzles 20, and/or a case in which a drive frequency of the piezoelectric actuator 8 is high (jetting interval is short), when the amount ink which is to be supplied from the inner manifold 17*b* is increased suddenly, there is a possibility that the sufficient amount of ink cannot be supplied from the inner manifold 17*b* to each pressure chamber 14.

In this embodiment, the communicating channels are formed at positions overlapping with all the partition walls 24 respectively, isolating the pressure chambers 14, and the outer manifolds 17*a* and the inner manifolds 17*b* communicate via these communicating channels 26. Consequently, when the amount of ink supplied from the inner manifolds 17*b* is substantial, the ink is replenished rapidly from the outer manifolds 17*a* to the inner manifolds 17*b*, and it is possible to prevent the insufficiency of ink in the inner manifolds 17*b*. Further, in this embodiment, since the outer manifold 17*a* is wider than the inner manifold 17*b*, it is possible to supply a sufficient amount of ink from the outer manifolds 17*a* to the inner manifolds 17*b*.

Furthermore, since the manifold plate 12 in which the communicating channels 26 are formed differs from the cavity plate 10 in which the pressure chambers 14 are formed, height positions of the pressure chamber 14 and the communicating channel 26 (positions in the direction of thickness of the plate) are mutually different. In other words, the pressure chambers 14 and the communicating channels 26 are arranged on mutually different planes. Therefore, it is possible to arrange the communicating channels 26 and the pressure chambers 14 to overlap in a plan view, and to miniaturize the head 1 by reducing the interval between the pressure chambers 14 belonging to each pressure chamber row 21 to be as much small as possible, as well as to replenish the ink rapidly to the inner manifold 17*b* by increasing the width (channel area) of the communicating channel 26.

Next, modified embodiments in which various modifications are made in the embodiment, will be described. Same reference numerals are assigned to components similar to the components in the embodiment, and a repetitive description is omitted.

Figure 7A:
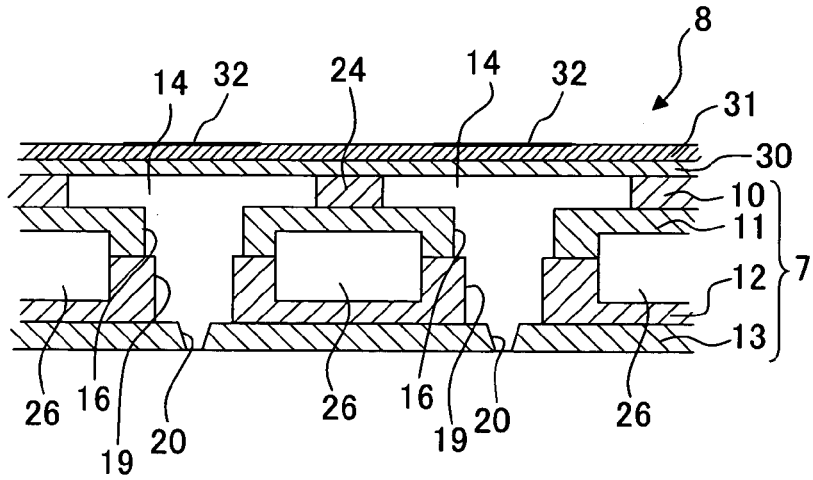
FIG. 7A is a cross-sectional view corresponding to FIG. 3 of an inkjet head in which a communicating channel is formed in a base plate and a manifold plate.
Figure 7B:
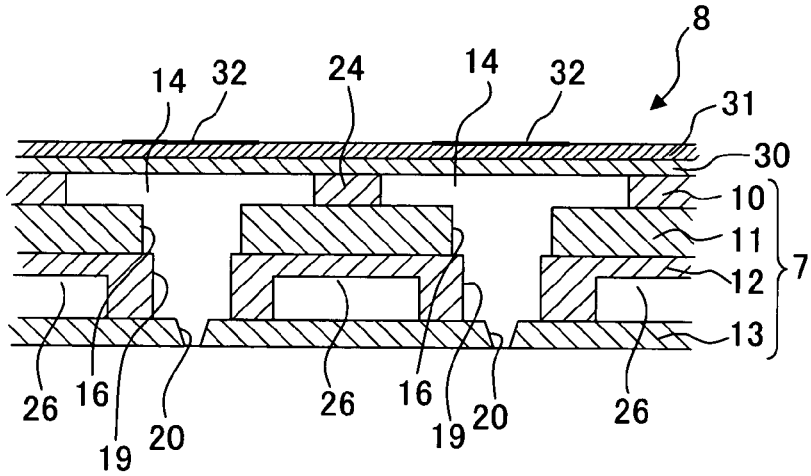
FIG. 7B is a cross-sectional view corresponding to FIG. 3 of an inkjet head in which a communicating channel is formed in a lower surface of a manifold plate.
Figure 7C:
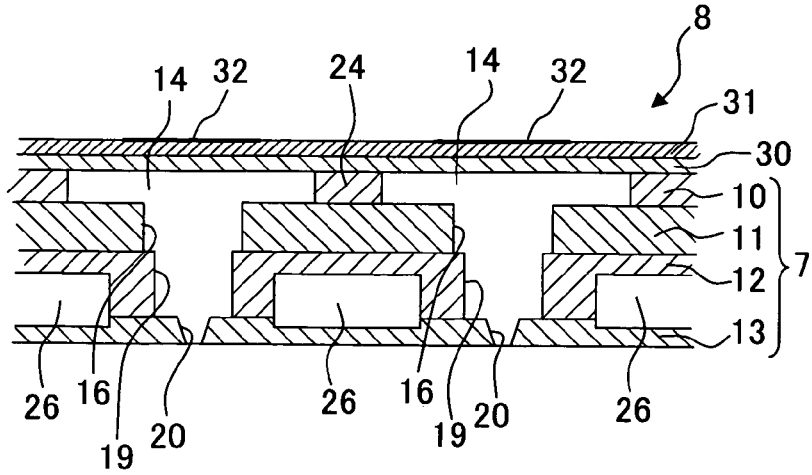
FIG. 7C is a cross-sectional view corresponding to FIG. 3 of an inkjet head in which a communicating channel is formed in a manifold plate and a nozzle plate.

In the embodiment described above, the communicating channel 26 is formed on the upper surface of the manifold plate 12. However, the position of forming the communicating channel 26 may not be restricted to be on the upper surface of the manifold plate 12. For example, as shown in FIG. 7A, a communicating channel 26A may be formed by a recess formed in the upper surface of the manifold plate 12, and a recess formed in a lower surface of the base plate 11. As shown in FIG. 7B, a communicating channel 26B may be formed by a recess formed in the lower surface of the base plate 11, and as shown in FIG. 7C, a communicating channel 26C may be formed by a recess formed in the lower surface of the base plate 11 and a recess formed in an upper portion of the nozzle plate 13. In a case in which, the recess is formed in each of the two plates as shown in FIG. 7A and FIG. 7C, a width of the recess formed in each plate may not be necessarily the same.

Figure 8:
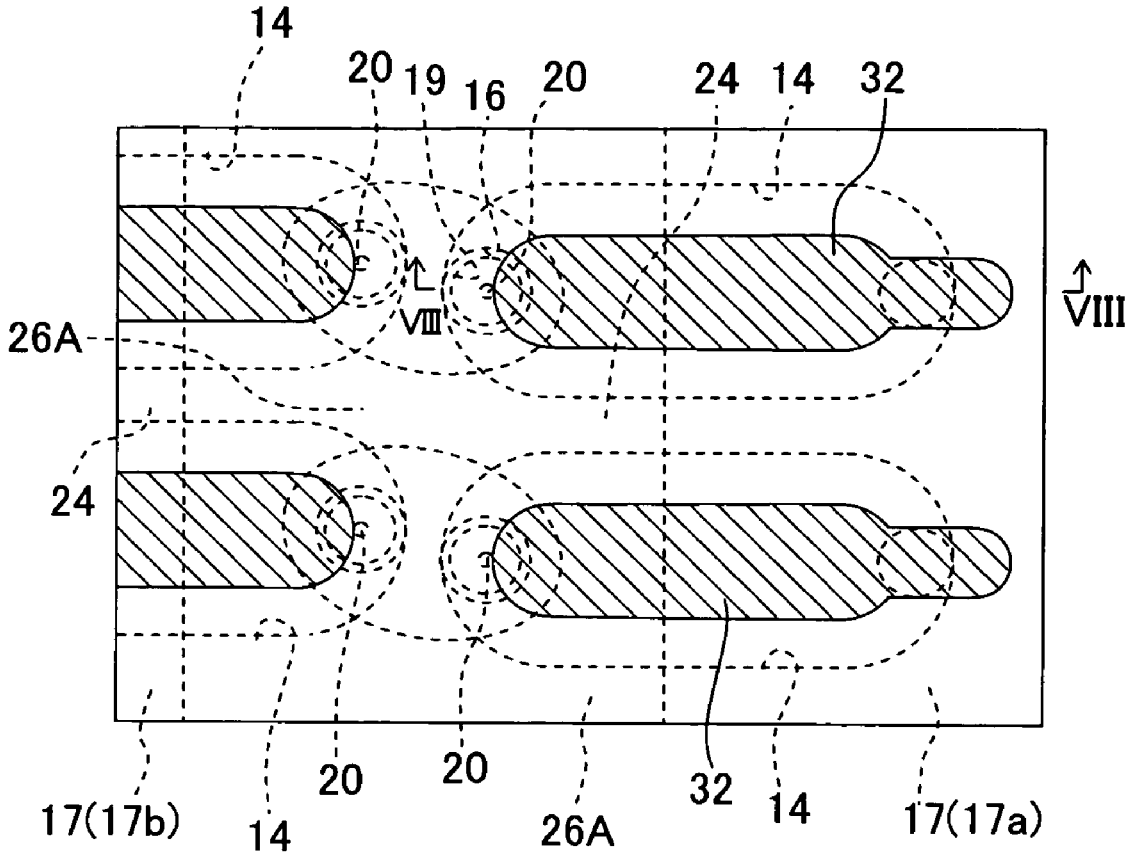
FIG. 8 is an enlarged view corresponding to FIG. 3 of an ink-jet head in a modified embodiment.
Figure 9:
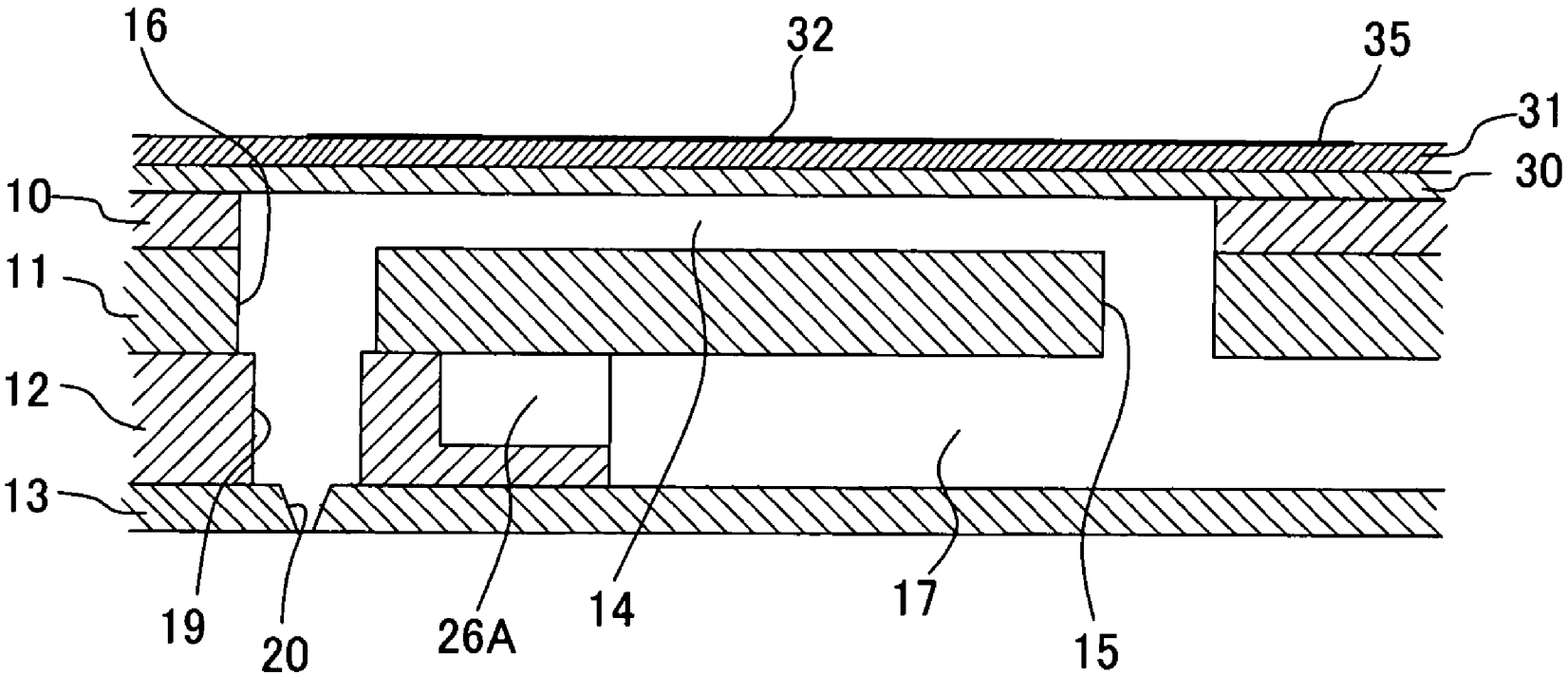
FIG. 9 is a cross-sectional view taken along a line IX-IX shown in FIG. 5.

As shown in FIG. 8 and FIG. 9, the communicating channel 26A may not be extended only up to an area of the manifold plate 12, overlapping with the partition wall 24, but also up to an area around the communicating holes 16 and 19, and the nozzles 20, and may be formed to surround a portion near the communicating holes 16 and 19, and the nozzles 20. In this case, since a plurality of communicating channels 26A communicate mutually at a lower side of the pressure chamber 14, the ink tends to flow easily between the outer manifold 17*a* and the inner manifold 17*b*, via the communicating channels 26A. Consequently, the ink is replenished rapidly from the outer manifold 17*a* to the inner manifold 17*b*. The communicating channel 26A, in addition to the recess formed in the manifold plate 12, or instead of the recess formed in the manifold plate 12, may be formed by a recess formed in the base plate 11 or the nozzle plate 13.

Figure 10A:
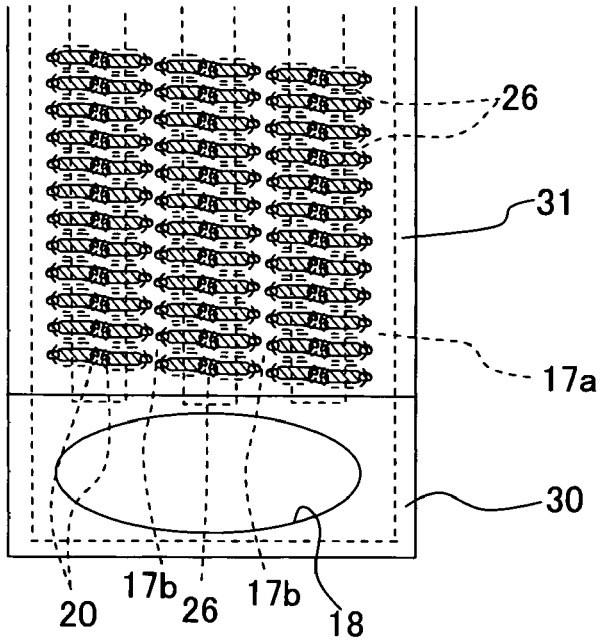
FIG. 10A is a partially enlarged plan view of a line ink-jet head 101.

In the embodiment described above, an arrangement and the number of manifolds, and an arrangement and the number of communicating channels is not restricted to a case in the embodiment, and may be arbitrary. In the embodiment, the communicating channels 26 are arranged in the manifold plate 12, at the positions overlapping with all the partition walls 24 which partition the pressure chambers 14 belonging to one pressure chamber row 21. However, when the communicating channel 26 is provided at a position overlapping with at least any one partition wall 24, it is possible to replenish the ink from the outer manifolds 17*a* to the inner manifolds 17*b*. Moreover, for example, a head 101 shown in FIG. 10A has a shape similar to the head 1 in the embodiment described above except for the points that an outer manifold 117*a* is narrower than an inner manifold 117*b*, and that a communicating channel which communicates between the outer manifold 117*a* and the inner manifold 117*b* is not formed. In this manner, in a case in which the width of the outer manifold 117*a* is narrowed to shorten a width of the head 101, only the communicating channel 26 which communicates between the inner manifold 117*b*, may be formed. In the head 101, the width of the outer manifold 117*a* may not be necessarily narrower than the width of the inner manifold 117*b*.

Figure 10B:
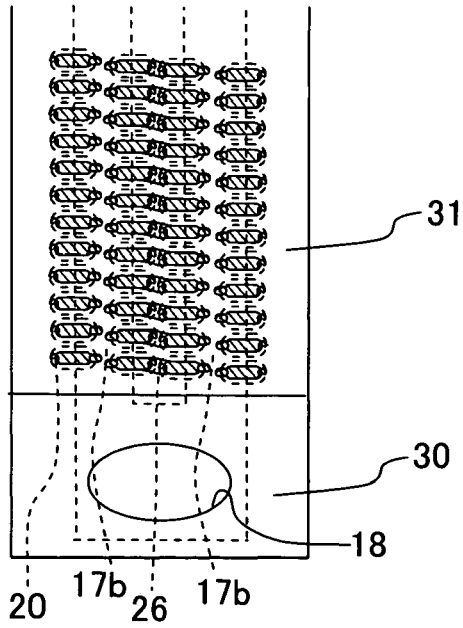
FIG. 10B is a partially enlarged plan view of a line ink-jet head 102.

Moreover, a head 102 shown in FIG. 10B has a shape similar to the head 101 except for a point that there is no outer manifold 117*a*, and a pressure chamber communicating with the outer manifold 117*a*. In this manner, a manifold may not be formed necessarily on a further outer side of the outermost pressure chamber row in a direction of width of the head 102.

The embodiments and the modified embodiments described above are examples in which the present invention is applied to the line ink-jet head. However, the present invention is also applicable to a serial ink-jet head which jets the ink on to a recording paper while moving in a predetermined direction.

It is also possible to apply the present invention to a liquid droplet jetting apparatus other than an ink-jet head which jets the ink. The present invention is also applicable to various liquid droplet jetting apparatuses which are used for forming a minute wiring pattern on a substrate by jetting an electroconductive paste, or a highly defined display by jetting an organic fluorescent substance on a substrate, and further a micro optical device such as an optical waveguide by jetting an optical resin on a substrate.

What is claimed is:

1. A liquid droplet jetting apparatus which jets a droplet of a liquid, comprising:

a channel unit which includes a plurality of nozzles, a plurality of pressure chambers arranged in a predetermined plane, a partition wall partitioning the pressure chambers, a plurality of common liquid chambers supplying the liquid to the pressure chambers, a plurality of liquid channels communicating the nozzles, the pressure chambers and the common liquid chambers, and a communicating channel communicating the common liquid chambers; and a pressure applying mechanism which applies selectively a jetting pressure to the liquid in the pressure chambers, wherein the communicating channel is formed in the channel unit, at a position which overlaps with the partition wall in an orthogonal direction which is orthogonal to a planar direction of the predetermined plane, and which is different from the pressure chamber in the orthogonal direction.

2. The liquid droplet jetting apparatus according to claim 1, wherein the pressure chambers are arranged as a plurality of pressure chamber rows each of which is comprised of pressure chambers arranged in a first direction; the common liquid chambers include outer common liquid chambers which are extended in the first direction at a further outer side of the pressure chamber row arranged on an outermost side in a second direction orthogonal to the first direction, and which communicate with pressure chambers belonging to the pressure chamber row on the outermost side, and inner common liquid chambers which are extended in the first direction between two mutually adjacent pressure chamber rows and which communicate with pressure chambers belonging to the two adjacent pressure chamber rows; and the inner common liquid chambers and the outer common liquid chambers communicate mutually via the communicating channel.

3. The liquid droplet jetting apparatus according to claim 2, wherein the communicating channel is extended in the second direction.

4. The liquid droplet jetting apparatus according to claim 2, wherein the nozzles are formed in the channel unit at positions different from positions of the pressure chamber in the orthogonal direction; the liquid channels include a connecting portion which connects the pressure chamber and the nozzle and which is extended in the orthogonal direction; and the communicating channel is formed at a same position as the connecting portion of the liquid channel in the orthogonal direction.

5. The liquid droplet jetting apparatus according to claim 4, wherein a length of the connecting portion of the liquid channel in the first direction is less than a length of the pressure chamber in the first direction.

6. The liquid droplet jetting apparatus according to claim 4, wherein a length of the connecting portion of the liquid channel in the first direction is less than a length of the communicating channel in the first direction.

7. The liquid droplet jetting apparatus according to claim 2, wherein a width of the communicating channel is more than a length of the partition wall in the first direction.

8. The liquid droplet jetting apparatus according to claim 2, wherein the communicating channel includes a communicating portion which communicates with the outer common liquid chambers and the inner common liquid chambers at both side of the communicating channel, and a midway portion between the communicating portions; and the communicating portion is wider than the midway portion.

9. The liquid droplet jetting apparatus according to claim 2, wherein the communicating channel includes a plurality of liquid chamber communicating channels, and the liquid chamber communicating channels are formed in the channel unit at positions overlapping with all the partition walls.

10. The liquid droplet jetting apparatus according to claim 2, wherein the outer common liquid chamber is wider than the inner common liquid chamber.

11. The liquid droplet jetting apparatus according to claim 2, wherein the channel unit has a plurality of stacked plates including a first plate in which the pressure chambers are formed and a second plate in which the communicating channel is formed.

12. The liquid droplet jetting apparatus according to claim 11, wherein the liquid chamber communicating channel is formed by a recess which is formed in one surface of the second plate.

13. The liquid droplet jetting apparatus according to claim 11, wherein the common liquid chamber is formed in the second plate.

14. The liquid droplet jetting apparatus according to claim 11, wherein the nozzles are formed in the second plate.

15. The liquid droplet jetting apparatus according to claim 11, wherein the second plate includes two plates which are stacked adjacently, and the communicating channel is formed by recesses which are formed on mutually facing surfaces of the two plates.

16. An ink-jet printer which jets a droplet of an ink on to a medium, comprising:

a transporting mechanism which transports the medium in a predetermined direction; and a head which includes a channel unit which has a plurality of nozzles, a plurality of pressure chambers arranged in a predetermined plane, a partition wall partitioning the pressure chambers, a plurality of liquid channels communicating the nozzles, the pressure chambers, and the common liquid chambers, and a communicating channel communicating the common liquid chambers, and a pressure applying mechanism which applies selectively a jetting pressure to the liquid in the pressure chambers, wherein the communicating channel is formed in the channel unit, at a position which overlaps with the partition wall in an orthogonal direction which is orthogonal to a planar direction of the predetermined plane, and which is different from the pressure chamber in the orthogonal direction.

17. The ink-jet printer according to claim 16, wherein the pressure chambers are arranged as a plurality of pressure chamber rows each of which is composed of pressure chambers arranged in a first direction, the common liquid chambers include outer common liquid chambers which are extended in the first direction at a further outer side of the pressure chamber row arranged on an outermost side in a second direction orthogonal to the first direction, and which communicate with pressure chambers belonging to the pressure chamber row on the outermost side, and inner common liquid chambers which are extended in the first direction between two mutually adjacent pressure chamber rows and communicate with pressure chambers belonging to the two adjacent pressure chamber rows; and the inner common liquid chambers and the outer common liquid chambers communicate mutually via the communicating channel.

18. The ink-jet printer according to claim 17, wherein the communicating channel is extended in the second direction.

19. The ink-jet printer according to claim 17, wherein the nozzles are formed in the channel unit at positions different from positions of the pressure chambers in the orthogonal direction; the liquid channels include a connecting portion which connects the pressure chamber and the nozzle, and which is extended in the orthogonal direction; and the communicating channel is formed at a same position as the connecting portion of the liquid channel in the orthogonal direction.

20. The ink-jet printer according to claim 17, wherein a width of the communicating channel is more than a length of the partition wall in the second direction.

* * * * *